US005394586A

United States Patent [19]

Holley

[11] Patent Number: 5,394,586

[45] Date of Patent: Mar. 7, 1995

[54] BALLAST SWEEPER DUST CONTROL

[75] Inventor: John D. Holley, Montgomery, Ala.

[73] Assignee: Holley Engineering Company, Inc., Montgomery, Ala.

[21] Appl. No.: 51,367

[22] Filed: Apr. 23, 1993

[51] Int. Cl.[6] ..... A47L 5/22

[52] U.S. Cl. ..... 15/347; 15/55; 15/340.3; 15/349

[58] Field of Search ..... 15/340.3, 347, 349, 15/55

[56] References Cited

U.S. PATENT DOCUMENTS

| | | | |
|---|---|---|---|
| Re. 31,619 | 7/1984 | Holley . | |
| 3,005,274 | 10/1961 | Kershaw | 15/55 X |
| 3,719,966 | 3/1973 | Lamont | 15/385 |
| 4,007,026 | 2/1977 | Groh | 15/349 X |
| 4,110,864 | 9/1978 | Gunnarson | 15/346 |
| 4,200,953 | 5/1980 | Overton | 15/349 |
| 4,285,737 | 8/1981 | Price | 15/55 X |
| 4,650,504 | 3/1987 | Howeth . | |
| 4,708,723 | 11/1987 | Howeth . | |
| 4,756,727 | 7/1988 | Howeth . | |
| 4,773,121 | 9/1988 | Young | 15/346 |
| 4,802,983 | 2/1989 | Howeth . | |
| 5,172,638 | 12/1992 | Mathison et al. . | |
| 5,303,448 | 4/1994 | Hennessey et al. | 15/349 X |

*Primary Examiner*—Chris K. Moore

*Attorney, Agent, or Firm*—Kerkam, Stowell, Kondracki & Clarke

[57] ABSTRACT

A railroad ballast sweeper controls dust by use of a double segmented skirt arrangement. Segments of elastic, flexible material extend downwardly from a housing in which a rotary broom is disposed. The skirts prevent leakage of dust-laden air out from the housing. Further, a fan and associated filters are used to draw air out from within the housing, thus creating a slight negative pressure within the housing. A grate having a series of metallic strip grate elements is used to block dust from reaching the filters. The grate elements force air to turn up abruptly in order to get to the filters, whereas the dust, by virtue of its higher mass, is generally unable to make a sufficiently quick change in direction in order to reach the filters. The grate has an orientator to insure that, upon replacing the grate, any new grate will necessarily be inserted with the proper orientation. In order to prevent air and particles propelled by the broom elements of the broom from opening the skirts and allowing dust-laden air to escape, a metallic break-up deflector strip or member is mounted adjacent the periphery of movement of outer tips of the broom elements.

24 Claims, 3 Drawing Sheets

BALLAST SWEEPER DUST CONTROL

BACKGROUND OF THE INVENTION

This invention relates to ballast sweepers for sweeping the ballast on railroad tracks. More specifically, this invention relates to dust control for such ballast sweepers.

The use of ballast sweepers in connection with maintenance of a railroad track is well known. Commonly, a plow or blade-like element is used to shape or distribute the ballast in a desired arrangement. However, when ballast is plowed or new ballast is dumped onto a railway roadbed, ballast may become disposed upon the tops of the railroad ties.

In order to evenly distribute the ballast and clear ballast from the tops of the railroad ties, it is common to use a railroad maintenance machine having a rotary sweeping core with a plurality of sweeper elements or bristles such as disclosed in the present inventor's prior U.S. Pat. No. Re. 31,619 issued Jul. 3, 1984 and hereby incorporated by reference. That patent describes a particular sweeper element or bristle and a method of making it. The rotary core may be mounted on the same machine as the plow blade.

The ballast is usually a thick layer of crushed limestone placed between and along side of the rails. As will be readily appreciated, the sweeping of the limestone from off the tops of the ties generates a very large amount of dust. The dust creates very harsh conditions such that the air filter on the engine which propels the broom or sweeper machine along the tracks must be replaced very often. Further, the dust covers and damages other parts of the vehicle.

More important than the effect of the dust on various parts of the maintenance vehicle having a rotary sweeper, the dust creates undesirable conditions for the operator riding on the vehicle. In addition to the discomfort associated with large amounts of dust falling on the clothing of the machine operator, there is some concern over potential health problems. Preferably, the operator will wear a dust mask to minimize the amount of dust which might otherwise be inhaled, but wearing such a mask is often uncomfortable.

Another problem created by the dust is that the amount of dust created by operation of such machines may lead to problems with government environmental regulators.

In order to minimize the problem of dust in connection with such machines, at least two different approaches have been proposed. A first approach has been to use a fan to remove air, by way of a filter, from within a housing in which the rotary sweeper is disposed. Dust within the air being removed from inside the housing builds up on the filter elements very quickly. Accordingly, the filter elements are sequentially backwashed by applying a high pressure air blast against the normal flow of air through the filter such that debris on the filter will fall into a hopper from which it can be periodically released. Since a large amount of dust is deposited on each filter between the periodic blast of backwashing air, the filter elements tend to wear out relatively quickly. Additionally, it is generally disadvantageous to have to provide a hopper to catch the dust and to take the time to periodically release the dust from the hopper. Finally, even with this technique of filtering air removed from the housing in which the broom's rotary core is disposed, a significant amount of dust may escape from the bottom periphery of the housing.

The arrangement of using filters with rotary broom machines and backwashing the filters is disclosed in one or more of the following U.S. patents issued to David Franklin Howeth and which are hereby incorporated by reference: U.S. Pat. Nos. 4,802,983; 4,756,727; 4,708,723; and 4,650,504. The U.S. Pat. No. 4,802,983 patent has a hopper to catch the dust which was blown off the filters by a backwashing air blast as discussed.

A second approach which has been considered is to use a spray of water against the dust such that it will fall back to the ground. However, the amount of dust which is generated is so large that a great amount of water must be used. A water reservoir must be located on the machine and the water adds substantial weight to the machine. If one attempts to reduce the weight by using a smaller reservoir or water tank, the water must be replaced quite often.

U.S. Pat. No. 5,172,638 issued to Mathison et al on Dec. 22, 1992 relates to a dust suppression system using a liquid spray to reduce dust for a ballast cleaning apparatus. The ballast cleaning apparatus is used to break up and clean ballast which may have been cemented together by water, mud, and other conditions.

OBJECTS AND SUMMARY OF THE INVENTION

Accordingly, it is a primary object of the present invention to provide dust control for a ballast broom vehicle.

A more specific object of the present invention is to provide such dust control without requiring a hopper to collect dust.

Yet another object of the present invention is to provide dust control for a ballast broom without requiring water or other liquids to spray against the dust.

Yet another object of the present invention is to provide dust control for a ballast broom which is highly efficient.

Yet another object of the present invention is to provide a new and improved railroad ballast broom grate to minimize the wear on the filters in a dust control arrangement.

The above and other objects of the present invention which will become more apparent as the description proceeds are realized by a railroad ballast broom vehicle including a vehicle frame having front and back pairs of rail-engaging wheels. A broom is mounted to the vehicle frame and has a housing and a rotary core with broom elements fixed to rotate therewith about a rotation axis. The housing partially encloses the rotary core and broom elements. A fan is mounted to the housing and disposed to blow air on an air flow path from within the housing to outside the housing. A grate with grate elements thereon is disposed in the air flow path and the grate has air passages therein between adjacent pairs of grate elements. The air passages are disposed to allow passage of air and the grate elements block passage of most dust. The grate is disposed adjacent to a periphery of movement of outer tips of the broom elements. The air passages are disposed at an angle and away from a tangent velocity of the outer tips at a nearest point on the periphery. In other words, the outer tips of the broom elements move in a circular path and have a tangent velocity at a point of the periphery nearest to the grate. The air passages are disposed at an angle and away from that tangent velocity in the sense that any air passing along the air passages must turn and reverse direction by flowing at least partially backwards relative to the tangent velocity.

A filter is in the air flow path downstream from the grate. The grate elements are parallel strips arranged in a plane and the grate elements are inclined relative to the plane. The grate includes a frame around outer edges of the grate and supporting the grate elements. An orientator on the frame is operable to mate with a corresponding mating part of the broom such that the grate will only fit in the broom when oriented properly. The grate is removably disposed in the air flow path meaning that it is not welded or otherwise permanently affixed in the path. The fan and the grate dry separate (i.e., meaning without liquid spray) dust from air and the broom redeposits the separated dust in a railroad bed immediately after separation (i.e., without use of a hopper or other container for dust).

The present invention may alternately be described as a railroad ballast broom vehicle including a vehicle frame, broom, and fan as discussed and having a first skirt of flexible material disposed around a lower periphery of the housing and a second skirt of flexible material within the first skirt and disposed around the lower periphery of the housing. The fan is operable to create a negative pressure within the first skirt and the housing and create an intermediate pressure between the first and second skirts. The intermediate pressure is intermediate to the negative pressure and an ambient pressure outside of the housing. The first and second skirts are segmented with segments of adjacent flexible material.

The present invention may alternately be described as a vehicle including a vehicle frame, broom, and fan as discussed and having a break-up deflector disposed inside the housing and adjacent a downward traveling side of a periphery of movement of outer tips of the broom elements. The deflector is a member extending lengthwise parallel to the rotation axis and having an upper surface blocking tangential downward air flow at a point on the periphery.

The present invention may alternately be described as railroad ballast broom grate for deflecting dust flow and separating air from dust including grate elements which are parallel strips arranged in a plane, the grate elements inclined relative to the plane and having inclined air passages between adjacent pairs of the grate elements. A frame is disposed around outer edges of the grate and supports the grate elements. An orientator is on the frame and is operable to mate with a corresponding mating part of a railroad ballast broom such that the grate must be oriented properly to fit in the railroad ballast broom. The orientator preferably is a cut-off corner on the frame. The ballast broom grate is combined with a railroad ballast broom vehicle as discussed.

The method of the present invention is a method of ballast regulation including the step of moving a railroad ballast broom vehicle having a vehicle frame with front and back pairs of rail-engaging wheels. A broom mounted to the vehicle frame is operated to act on ballast of a railroad bed, the operating causing rotation of the rotary core and broom elements of the broom. A fan mounted to the housing is operated so as to blow air on an air flow path from within the housing to outside the housing and thereby dry separate (i.e., without use of liquid sprays) dust from air. The separated dust is redeposited on the railroad bed immediately after separation (i.e., without being temporarily stored in a hopper or other container).

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
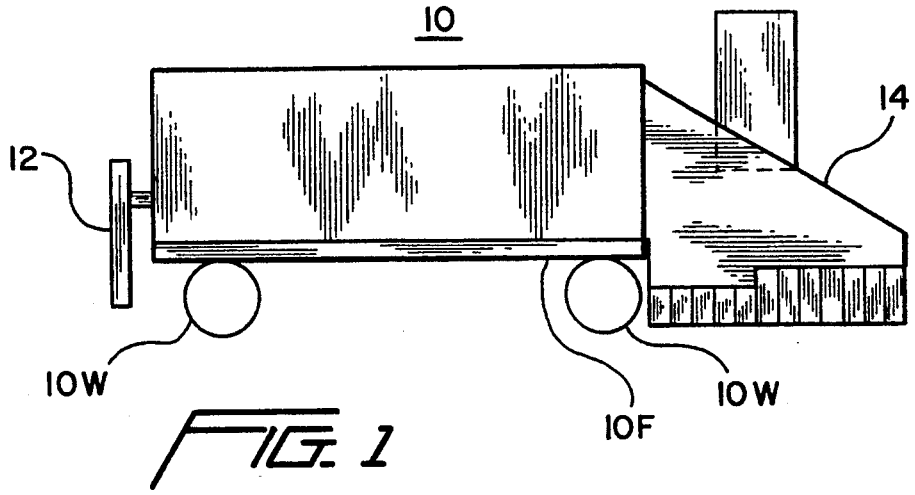
FIG. 1 is a simplified side view of a ballast regulator or rotary broom vehicle according to the present invention.

Initially with reference to FIG. 1, a simplified side view shows a ballast regulator vehicle 10 according to the present invention. The vehicle 10, which may also be called a ballast broom vehicle, is shown in highly schematic form as including a frame 10F and front and back pairs of wheels 10W which engage rails (not shown). Mounted at one end of vehicle 10 is a plow 12, which may be of known construction, for plowing or redistributing ballast along a roadbed.

Mounted at the other end of vehicle 10 is a broom or ballast sweeper machine 14. The ballast sweeper 14 is mounted, directly or indirectly, to the vehicle frame 10F and supported thereby. As the broom 14 includes numerous parts which are constructed in known fashion, the present description will not go into detail with respect to such parts. Instead, the description which follows will concentrate on those aspects of the broom 14 which differ from the standard machines.

Figure 2:
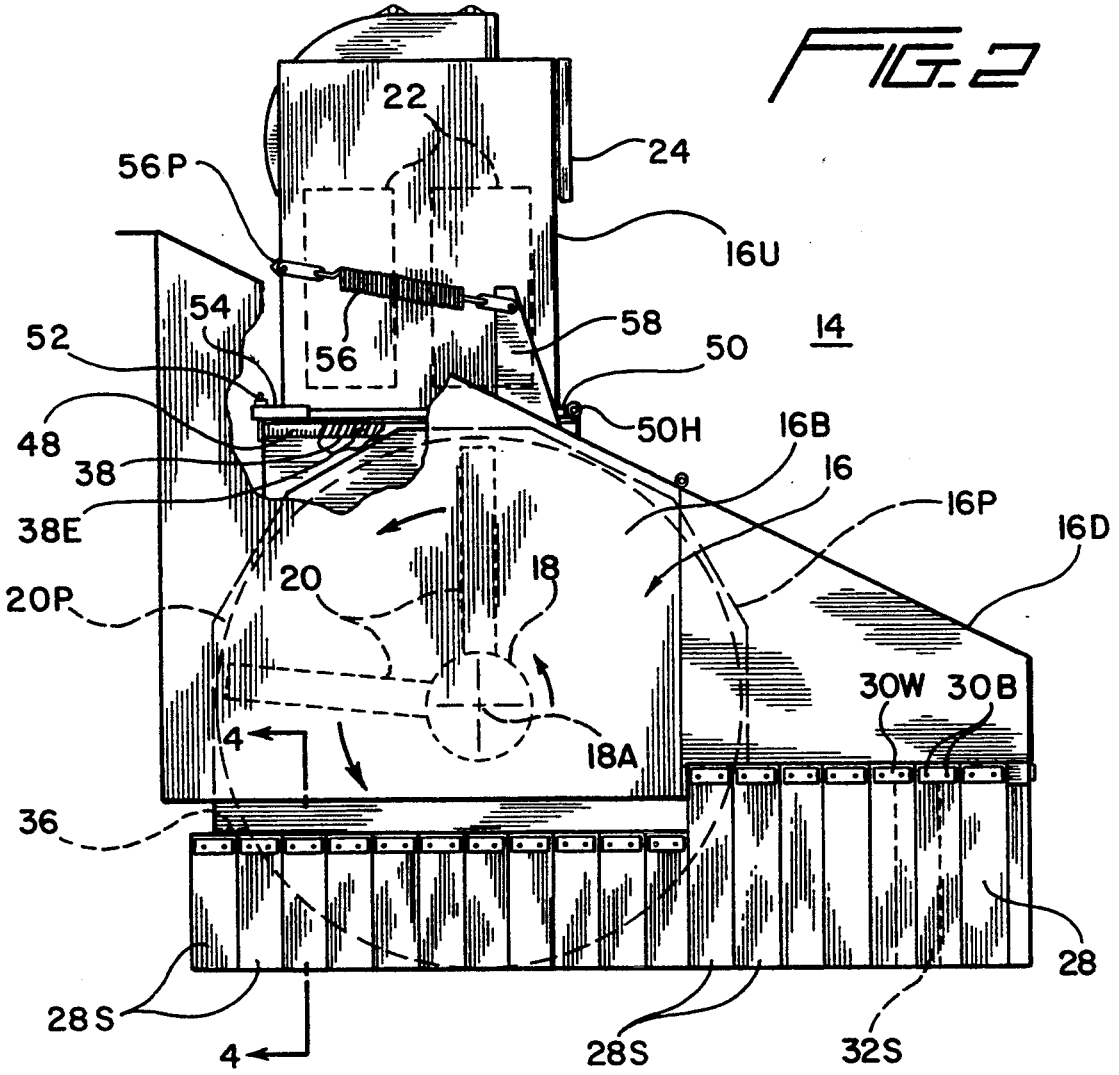
FIG. 2 shows a side view of the broom and related structure of the present invention.
Figure 3:
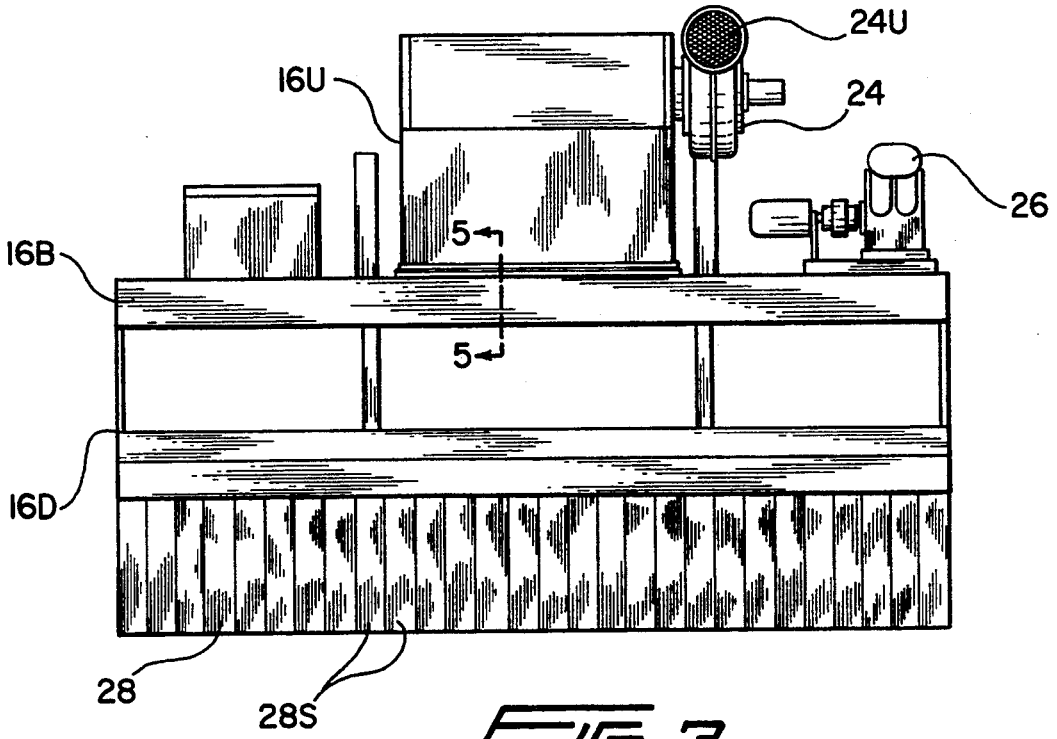
FIG. 3 shows a front view of the broom and related structure of the present invention.

With reference now to FIGS. 2 and 3, the broom 14 has a broom housing 16 which includes a portion 16B around the rotary core 18 and broom or sweeper elements 20 in known fashion. For ease of illustration, only two of the broom elements 20 are shown. It will be understood that numerous ones of the broom elements 20 would be disposed at different angular and axial locations along the cylindrical core 18, which rotates about axis 18A, normal to the plane of view of FIG. 2. The housing portion 16B includes an outer periphery 16P just outside a periphery of movement 20P of outer tips of the broom elements 20.

The broom housing 16 includes a portion 16D in which deflectors (not shown) are disposed in order to redistribute ballast swept off of railroad ties by broom elements 20 in known fashion as the vehicle moves rightwardly (in the view of FIG. 2) and the core 18 rotates at about 220 revolutions per minute in a counterclockwise direction (relative to the view of FIG. 2).

The broom housing 16 includes an upper portion 16U in which a series of filters 22 (FIG. 2 only) are disposed. Air from within the portion 16B is drawn into portion 16U where dust is caught by 6 filters 22 (arranged in a two by three pattern, only two shown in FIG. 2) by operation of blower fan 24 expelling air out outlet 24U (FIG. 3 only). A compressor 26 (FIG. 3 only) supplies compressed air periodically and sequentially to the 6 filters, one at a time, in order to backwash them. In other words, the blasts of air knock dust off the filters to prevent them from clogging. The compressor 26 has hoses, not shown, and uses an unshown distribution system to supply the blasts of air which backwash the filters 22.

Figure 4:
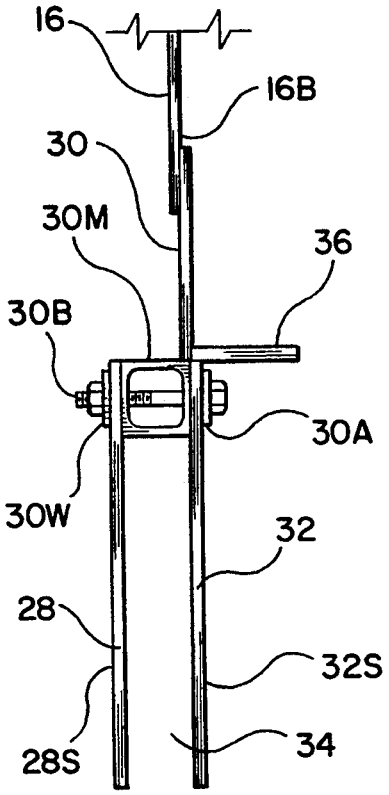
FIG. 4 shows a partial cross section view taken along lines 4—4 of FIG. 2 and illustrating skirts and an air deflector according to the present invention.

Turning now to parts of the broom 14 which are different from the prior techniques, reference is made to FIG. 4, while continuing to consider FIGS. 2 and 3. Disposed around the lower periphery of the housing 16 is a first skirt 28 having a series of segments 28S made of rubber or similar elastic, flexible material. As shown in the detailed view of FIG. 4, the housing portion 16B has a mounting bracket 30 to which the individual segments 28S of skirt 28 are bolted, each segment by two bolts such as bolt 30B holding washer 30W against segment 28S and mounting member or strip 30M (FIG. 4 only). The various segments 28S, which are separate strips of rubber or similar material, are used to prevent dust from escaping around the lower periphery of the broom housing 16. By making this first skirt 28 segmented, the skirt 28 will better contain dust within the housing. If an obstruction is touched by one of the segments 28S, the segments 28S which are not touching the obstruction will not be moved upward and will maintain a seal at other locations. The segments 28S are of a length such that they just barely touch the ground under ordinary circumstances (i.e., no obstructions). By making them out of rubber or similar elastic, flexible material, the segments 28S will not bind, break, or slow movement of the vehicle if an obstruction is touched by them.

With reference now to FIG. 4, a second skirt 32 is disposed around the lower periphery of the broom housing 16 just inside of the first skirt 28. The second skirt 32 includes a series of segments 32S (only one shown in FIG. 4) held to mounting strips such as 30M by bolts such as 30B and washers such as 30A. As with the segments 28S, there may be two bolts 30B securing each of the segments 32S. As seen in FIG. 4, the bolt 30B secures an outer skirt segment 28S at one side and an inner skirt segment 32S at another side. The washers 30W or 30A may be metallic retention plates as best shown in FIG. 2. As illustrated by a single inner segment 32S shown in phantom line in FIG. 2, the segments of the inner skirt 32 are staggered relative to the segments 28S. In other words, the line between two adjacent pairs of the segments 32S is centrally located (in the plane of view of FIG. 2) relative to a particular one of the segments 28S. Likewise, the segments 28S have their side edges centrally located (in the plane of view of FIG. 2) relative to ones of the segments 32S. This staggering helps to maintain an air seal around the lower periphery of the broom housing 16. As shown in FIG. 2, the skirt 28 may use longer segments 28S mounted to the deflector portion 16D of housing 16 than the segments 28S mounted at the lower periphery of portion 16B since portion 16B extends closer to the ground. Each of the skirts 28 and 32 extends completely around the lower periphery of housing 16 so as to minimize the leakage of any dust-laden air out from the lower periphery of the broom housing 16. If one or more of the segments 28S and/or 32S loses contact with the ground due to some momentary obstruction, the fan 24 will minimize or prevent any dust leakage. The fan 24 maintains a negative pressure within the broom housing 16 such that upon any of the segments 28S or 32S being lifted, air will tend to leak into the interior of housing 16, thus preventing any dust-laden air from escaping. The fan 24 maintains the interior of broom housing 16 at the negative pressure, whereas the zone 34 (FIG. 4 only) in between the first or outer skirt 28 and the second or inner skirt 32 is generally maintained at an intermediate pressure which is between the negative interior pressure of broom housing 16 and the ambient pressure outside of the housing 16.

Continuing to view FIGS. 2 and 4, a generally horizontal break-up deflector member 36 is welded or bolted (bolts not shown) on the inside surface of mount member 30 (see especially FIG. 4). The deflector, which may be made of metal three inches wide, extends parallel and lengthwise to the same extent as the generally cylindrical rotary core 18. As shown in FIG. 2, the deflector 36 is disposed just outside of the periphery of movement 20P of the outer tips of broom elements 20. Since the broom elements 20 are being rotated at relatively high speed, such as 220 revolutions per minute, this tends to create a high pressure zone at deflector 36. The broom elements effectively act as a fan and throw dust and air down into the ground adjacent to or below the deflector 36. In the absence of the deflector 36, that high pressure area will tend to lift up the skirt segments 28S and 32S such that dust-laden air will escape adjacent to the high pressure location. To avoid having such dust-laden air escape, the deflector 36 creates turbulence which reduces the build-up of high pressure at that location. Specifically, the turbulence is created when dust-laden air is propelled along the outer tips of broom elements 20 and is propelled outside of the periphery of movement 20P by centrifugal force. This dust-laden air then is propelled toward the horizontal upper surface of deflector 36, thereby blocking tangential downward air flow at a point adjacent to the periphery of movement 20P. The air blocked by deflector 36 is forced back within the periphery 20P and dissipates the high pressure buildup which would otherwise cause leakage of dust-laden air.

Figure 5:
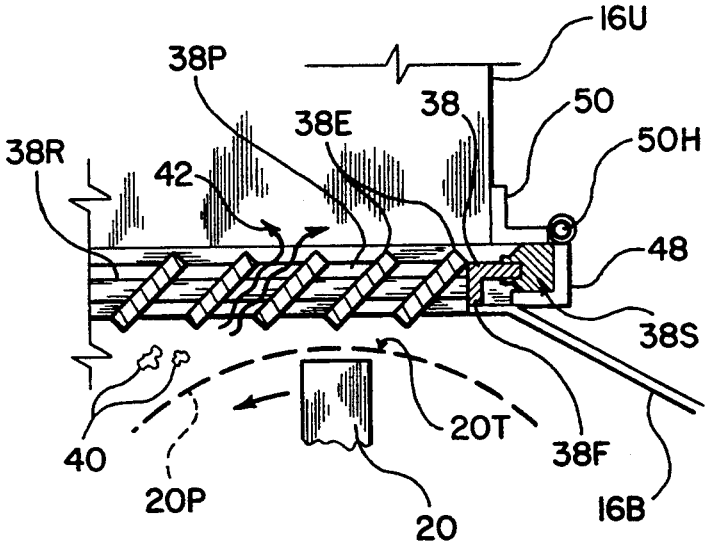
FIG. 5 shows a grate and related structure with parts in cross section view as taken along lines 5—5 of FIG. 3.

With reference now to FIG. 2 and FIG. 5, a grate 38 is disposed where the upper portion 16U of housing is mounted to the portion 16B. The grate 38 includes a series of grate elements 38E. The grate 38, only a portion of which is shown in the broken away part of FIG. 2 and only a portion of which is shown in FIG. 5, is generally rectangular and controls air flow from within housing portion 16B to within upper portion 16U. The grate elements 38E are a series of metallic strips which operate to minimize wear on the filters disposed in the upper housing 16U (filters not shown in FIG. 5). As the broom elements 20 rotate around the periphery of movement 20P, dust and particles of ballast depicted as 40 are propelled tangentially and outward (by centrifugal force) along the periphery of movement 20P. The grate 38 shields against dust-laden air being pulled into the upper housing 16U by the fan 24 (FIG. 2, not shown in FIG. 5). Particles of dust which might otherwise sandblast the filters disposed within upper housing 16U, are blocked from movement into upper housing 16U. Specifically, the inclined orientation of the grate elements 38E blocks the direction in which such dust particles would normally move under a combination of tangential motion imparted by broom elements 20 and centrifugal force from the rotation.

Significantly, in addition to blocking the dust-laden air from movement which it otherwise would make, the grate 38 functions as a separator. The fan within upper housing portion 16U is pulling in air from housing portion 16B by way of a series of parallel and inclined air passages 38P disposed between adjacent pairs of the grate elements 38E. However, particles such as dust particles 40 have a counterclockwise momentum in the view of FIG. 5. Therefore, the inertia of such particles causes them to greatly resist being pulled backwards (away from the tangential motion imparted by broom elements 20) through the air passageways 38P. However, the air spinning out from the tips of broom elements 20 will tend to be pulled backward as indicated by gas movement 42. Since the air has significantly less mass than the dust within the air, the air can be pulled backwards away from its original direction of movement much more easily than the dust particles 40. By thus forcing the air to change directions very quickly from moving counterclockwise or leftwardly at the tangent of periphery 20P, the dust is unable to move with the air since the dust cannot change directions as quickly. This skimming operation greatly reduces the wear to the filters within the upper housing 16U. Further, with the broom elements 20 fanning the dust particles 40 back towards the ground, the dust particles 40 will be redeposited on the ground. This separation of dust from air by the grate 38 occurs because the air passages 38P are disposed at an angle and away from a tangent velocity vector of the outer tips of broom elements 20 at a nearest point 20T of the periphery of movement 20P. The air passages are directed away from the tangent velocity vector in that air can pass through the grate 38 only by reversing direction from its movement along the tangent of periphery 20P.

Although grate 38 will greatly reduce the amount of dust passing into the upper housing 16U, the dust which does manage to get through will be trapped by one of the filters 22 (FIGS. 2 and 3 only). The filters 22 may have plates (not shown) or other structure between them to insure that any air passing out of port 24U (FIG. 3 only) must pass through at least one of the filters 22. The greatly reduced dust received by the filters 22 is blasted off the filters one at a time as discussed above. Since the air blast used for backwashing the filters 22 is at much higher pressure than the negative pressure induced by the fan 24, dust thus backwashed off the filters 22 falls back between the grate elements 38E and is redeposited upon the ground. Significantly, the fan 24 cooperates with the grate 38 to dry separate (i.e., without liquid sprays) dust from air and the broom redeposits the separated dust on a railroad bed immediately after separation (i.e., there is no hopper or other collection container to collect the dust).

Figure 6:
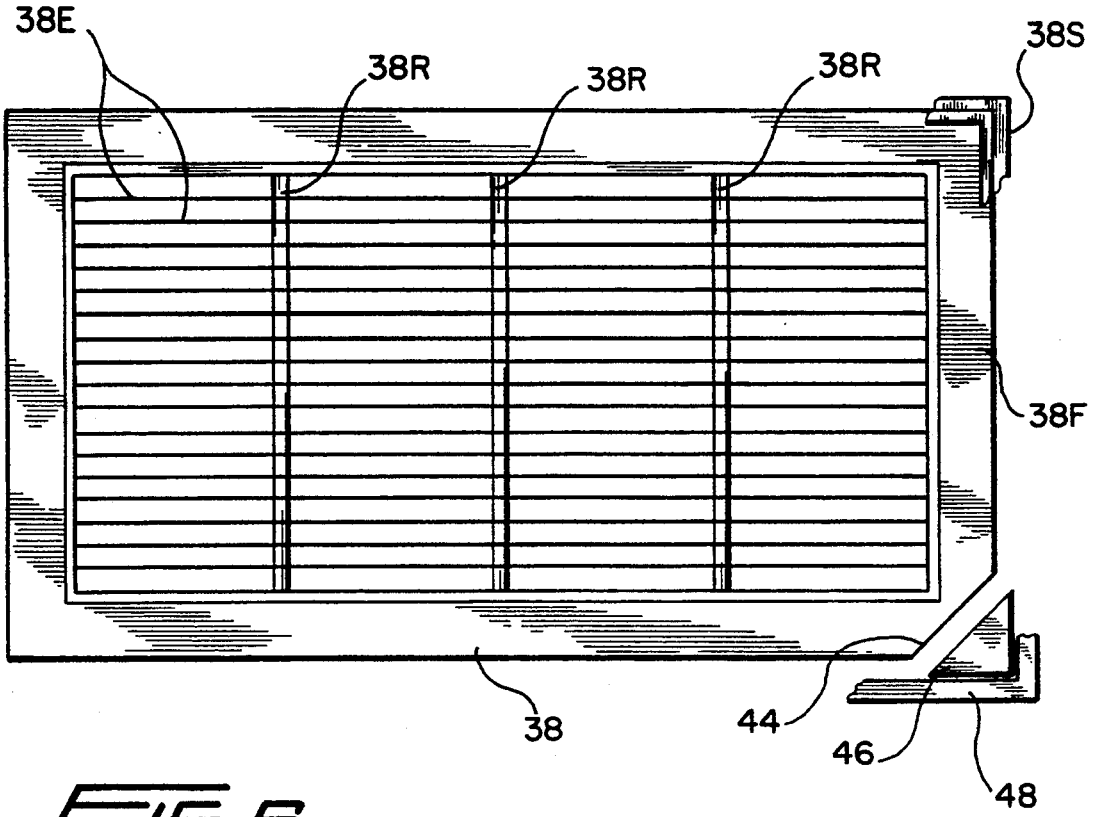
FIG. 6 is a planar view of the grate and related parts of the broom housing.
Figure 7:
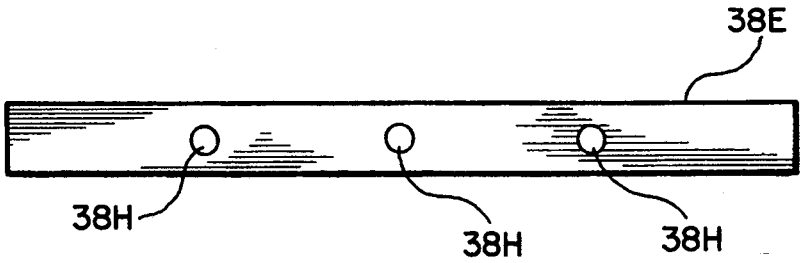
FIG. 7 is a side view of steel slats used in the grate.
Figure 8:
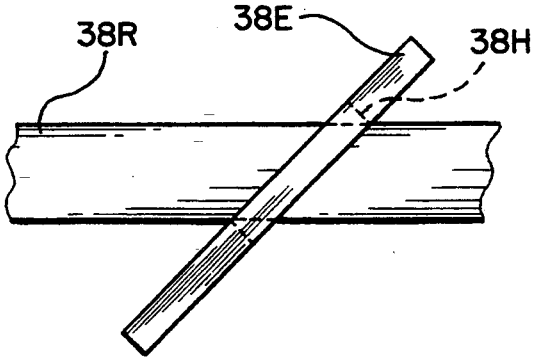
FIG. 8 is a detailed side view illustrating how grate elements are mounted to rods.

Continuing to view FIG. 5, but also referring to FIG. 6, the details of construction of the grate 38 will be discussed. The grate 38 is generally rectangular having an outer frame 38F which, as best shown in FIG. 5, is L-shaped in cross section. A rubber or similar material seal 38S extends completely around the periphery of frame 38F. For ease of illustration, only a portion of the seal is shown in FIG. 6. Extending between opposite sides of the frame 38F are three rods 38R extending in parallel and supporting the grate elements 38E which are strips of metal having their lengthwise direction extending perpendicular to the lengthwise direction of the rods 38R. The rods 38R support the grate elements 38E by virtue of holes 38H, shown in the FIG. 7 illustration of the structure of the steel grate elements 38E. In order to construct the grate 38, the grate elements 38E are positioned with the rods 38R extending through their holes 38H as illustrated on the detail view of FIG. 8. In the view of FIG. 8, the length direction of the element 38E is normal to the plane of view. Initially, the width direction of grate elements 38E is perpendicular to the length direction of the rods 38R. However, the various elements 38E are inclined to the position shown in FIG. 8 (the hole 38H is significantly larger than the diameter of the rods 38R) and the elements 38E are welded at the angular position inclined relative to the rods 38R. The ends of the rods are welded to opposite sides of the frame 38F. If desired, opposite ends of the grate elements 38E may likewise by welded to opposite sides of the grate frame 38F.

An important feature of the grate 38 is the use of an orientator 44 on the outside of frame 38F. In particular, and with reference to FIG. 6, the orientator 44 in the preferred embodiment is simply a cut-off corner of a portion of the frame 38F. The cut-off portion or orientator 44 is used in cooperation with a corresponding mating part 46 which is welded or otherwise fixed within a frame 48 (FIGS. 2, 5, and 6 only). The mounting frame 48 extends rectangularly around the bottom of upper housing portion 16U (FIG. 2) and above a corresponding opening in the housing portion 16B. The grate 38 is removably disposed within the frame 48 and the seal 38S insures that any air entering into upper portion 16B must pass through the grate 38. Extending rectangularly around the bottom of upper housing portion 16U is an L-shaped mounting bracket 50. Along one edge of bracket 50 is a hinge 50H defining an axis of rotation parallel to the horizontal rotation axis 18A of rotary core 18.

After a grate 38 has been worn out, it may be easily and readily replaced. Referring primarily to FIG. 2, several bolts such as bolt 52 are removed to free member 54 from being bolted against a part of the housing portion 16B. The member 54 may simply be a piece of steel welded or otherwise attached to the side of upper portion 16U. One might use one such member 54 on each side and a corresponding bolt 52 on each side. Upon removing such bolts 52, a person would push the upper portion 16U rightwardly in the view of FIG. 2 such that the upper portion 16U and various filters 22 within it pivots about hinge 50H. Since the weight of 16U and the associated filters 22 and fan 24 may be relatively high (about 600 lbs.), a counterbalance spring 56 extending between member 58 (which is mounted to housing portion 16B) and point 56P on upper housing portion 16U is used. If desired, one such spring 56 may be used on each side of the upper housing portion 16U. By use of the counterbalance springs such as 56, a person may rotate the upper housing portion 16U and associated structure about hinge 50H using only about 15 pounds of force. The spring 56 is sufficiently strong to limit rotation of portion 16U to about 80° clockwise from the illustrated position in FIG. 2. A person may then simply reach in and pull out the grate 38 for replacement with a new grate 38.

When placing a new grate 38 within the frame 48, the cut out portion 44 of grate frame 38F and the corresponding mating portion or block 46 prevents one from orienting the grate 38 improperly (see FIG. 6 especially). Although not illustrated completely around the frame 38F, the seal 38S would bend around with the corner 44. Referring back to FIG. 5 and recalling how the air passages 38P advantageously are disposed away from the tangent velocity of the broom elements 20, the significance of insuring that the grate 38 is oriented properly will be understood.

Although various specific constructions have been described, it is to be understood that these are for illustrative purposes only. Various modifications and adaptations will be readily apparent to those of skill in the art. Accordingly, the scope of the present invention will be determined by reference to the claims appended hereto.

What is claimed is:

1. A railroad ballast broom vehicle comprising: a vehicle frame having front and back pairs of rail-engaging wheels;

a broom mounted to said vehicle frame and having a housing and a rotary core with broom elements fixed to rotate therewith about a rotation axis, said housing partially enclosing said rotary core and broom elements;

a fan mounted to said housing and disposed to move air on an air flow path from within said housing to outside said housing; and a grate with grate elements thereon, said grate disposed in said air flow path and said grate having air passages therein between adjacent pairs of grate elements, said air passages disposed to allow passage of air and said grate elements blocking passage of most dust.

2. The railroad ballast broom vehicle of claim 1 wherein said grate is disposed adjacent to a periphery of movement of outer tips of said broom elements and wherein said air passages are disposed at an angle and away from a tangent velocity vector of said outer tips at a nearest point of said periphery.

3. The railroad ballast broom vehicle of claim 1 further comprising:

a first skirt of flexible material disposed around a lower periphery of said housing; and a second skirt of flexible material within said first skirt and disposed around said lower periphery of said housing; and wherein said fan is operable to create a negative pressure within said first skirt and said housing and is operable to create an intermediate pressure between said first and second skirts, said intermediate pressure being intermediate said negative pressure and an ambient pressure outside said housing.

4. The railroad ballast broom vehicle of claim 3 wherein said first skirt is segmented with segments of adjacent flexible material.

5. The railroad ballast broom vehicle of claim 4 wherein said second skirt is segmented with segments of adjacent flexible material.

6. The railroad ballast broom vehicle of claim 1 further comprising:

a break-up deflector disposed inside said housing and adjacent a downward traveling side of a periphery of movement of outer tips of said broom elements, said deflector being a member extending lengthwise parallel to said rotation axis and having an upper surface blocking tangential downward air flow at a point on said periphery.

7. The railroad ballast broom vehicle of claim 1 further comprising a filter in said air flow path downstream from said grate; and wherein said grate is removably disposable in said air flow path and said grate elements are parallel strips arranged in a plane, said grate elements are inclined relative to said plane, and said grate includes: a frame around outer edges of the grate and supporting said grate elements; and an orientator on said frame operable to mate with a corresponding mating part of said broom such that said grate will only fit in said broom when oriented properly.

8. The railroad ballast broom vehicle of claim 1 wherein said fan and said grate dry separate some dust from some air and said broom redeposits the separated dust on a railroad bed immediately after separation.

9. A railroad ballast broom vehicle comprising:

a vehicle frame having front and back pairs of rail-engaging wheels;

a broom mounted to said vehicle frame and having a housing and a rotary core with broom elements fixed to rotate therewith about a rotation axis, said housing partially enclosing said rotary core and broom elements;

a fan mounted to said housing and disposed to move air on an air flow path from within said housing to outside said housing;

a first skirt of flexible material disposed around a lower periphery of said housing; and a second skirt of flexible material within said first skirt and disposed around said lower periphery of said housing; and wherein said fan is operable to create a negative pressure within said first skirt and said housing and is operable to create an intermediate pressure between said first and second skirts, said intermediate pressure being intermediate said negative pressure and an ambient pressure outside said housing.

10. The railroad ballast broom vehicle of claim 9 wherein said first and second skirts are segmented with segments of adjacent flexible material.

11. The railroad ballast broom vehicle of claim 10 wherein said fan and said grate dry separate dust from air and said broom redeposits the separated dust on a railroad bed immediately after separation.

12. The railroad ballast broom vehicle of claim 11 further comprising a grate with grate elements thereon, said grate disposed in said air flow path and said grate having air passages therein between adjacent pairs of grate elements, said air passages disposed to allow passage of air and said grate elements blocking passage of most dust.

13. The railroad ballast broom vehicle of claim 12 further comprising a filter in said air flow path downstream from said grate; and wherein said grate elements are parallel strips arranged in a plane, said grate elements are inclined relative to said plane, and said grate includes: a frame around outer edges of the grate and supporting said grate elements.

14. A railroad ballast broom vehicle comprising:

a vehicle frame having front and back pairs of rail-engaging wheels;

a broom mounted to said vehicle frame and having a housing and a rotary core with broom elements fixed to rotate therewith about a rotation axis, said housing partially enclosing said rotary core and broom elements;

a fan mounted to said housing and disposed to move air on an air flow path from within said housing to outside said housing; and a first skirt disposed around a lower periphery of said housing, said first skirt being segmented with segments of adjacent flexible material; and wherein said fan is operable to create a negative pressure within said first skirt and said housing.

15. The railroad ballast broom vehicle of claim 14 a grate with grate elements thereon, said grate removably disposed in said air flow path and said grate having air passages therein between adjacent pairs of grate elements, said air passages disposed to allow passage of air and said grate elements blocking passage of most dust.

16. The railroad ballast broom vehicle of claim 15 further comprising a filter in said air flow path downstream from said grate; and wherein said grate elements are parallel strips arranged in a plane, said grate elements are inclined relative to said plane, and said grate includes: a frame around outer edges of the grate and supporting said grate elements.

17. The railroad ballast broom vehicle of claim 14 further comprising:

a break-up deflector disposed inside said housing and adjacent a downward traveling side of a periphery of movement of outer tips of said broom elements, said deflector being a member extending lengthwise parallel to said rotation axis and having an upper surface blocking tangential downward air flow at a point on said periphery.

18. A railroad ballast broom vehicle comprising:

a vehicle frame having front and back pairs of rail-engaging wheels;

a broom mounted to said vehicle frame and having a housing and a rotary core with broom elements fixed to rotate therewith about a rotation axis, said housing partially enclosing said rotary core and broom elements;

a fan mounted to said housing and disposed to move air on an air flow path from within said housing to outside said housing and a break-up deflector disposed inside said housing and adjacent a downward traveling side of a periphery of movement of outer tips of said broom elements, said deflector being a member extending lengthwise parallel to said rotation axis and having an upper surface blocking tangential downward air flow at a point adjacent to said periphery of movement.

19. The railroad ballast broom vehicle of claim 18 further comprising:

a grate with grate elements thereon, said grate removably disposed in said air flow path and said grate having air passages therein between adjacent pairs of grate elements, said air passages disposed to allow passage of air and said grate elements blocking passage of most dust.

20. The railroad ballast broom vehicle of claim 19 further comprising:

a first skirt of flexible material disposed around a lower periphery of said housing; and a second skirt of flexible material within said first skirt and disposed around said lower periphery of said housing; and wherein said fan is operable to create a negative pressure within said first skirt and said housing and is operable to create an intermediate pressure between said first and second skirts, said intermediate pressure being intermediate said negative pressure and an ambient pressure outside said housing.

21. A railroad ballast broom grate for deflecting dust flow and separating air from dust comprising:

grate elements which are parallel strips defining a plane along top edges thereof, said grate elements inclined relative to said plane and having inclined air passages between adjacent pairs of said grate elements;

a frame around outer edges of the grate and supporting said grate elements; and an orientator on said frame operable to mate with a corresponding mating part of a railroad ballast broom such that said grate must be oriented properly to fit in the railroad ballast broom.

22. The railroad ballast broom grate of claim 21 combined with a railroad ballast broom vehicle comprising:

a vehicle frame having front and back pairs of rail-engaging wheels;

a broom mounted to said vehicle frame and having a housing and a rotary core with broom elements fixed to rotate therewith about a rotation axis, said housing partially enclosing said rotary core and broom elements;

a fan mounted to said housing and disposed to blow air on an air flow path from within said housing to outside said housing.

23. The railroad ballast broom grate of claim 21 wherein said orientator is a cut-off corner on said frame.

24. A method of ballast regulation comprising the steps of:

moving a railroad ballast broom vehicle having a vehicle frame with front and back pairs of rail-engaging wheels;

operating a broom mounted to the vehicle frame to act on ballast of a railroad bed, the broom having a housing and a rotary core with broom elements fixed to rotate therewith about a rotation axis, said housing partially enclosing said rotary core and broom elements, the operating causing rotation of the rotary core and broom elements; and operating a fan mounted to said housing so as to blow air on an air flow path from within said housing to outside said housing and thereby dry separating some dust from air; and redepositing the separated dust on said railroad bed immediately after separation.

* * * * *